US006076532A

United States Patent [19]

Thomas et al.

[11] Patent Number: 6,076,532

[45] Date of Patent: Jun. 20, 2000

[54] HEAD BAND, HAIR BAND AND HAIR GATHERING DEVICE

[76] Inventors: Steven R. Thomas; Diana H. Thomas, both of 741 Old Farm Rd., Bridgewater, N.J. 08807

[21] Appl. No.: 09/347,793

[22] Filed: Jul. 6, 1999

[51] Int. Cl.[7] ..... A45D 8/04

[52] U.S. Cl. ..... 132/273; 2/144; 2/171; 2/DIG. 11

[58] Field of Search ..... 2/171, DIG. 11, 2/144; 132/273, 274, 275

[56] References Cited

U.S. PATENT DOCUMENTS

| | | | |
|---|---|---|---|
| D. 344,176 | 2/1994 | Lawrence . | |
| 4,723,325 | 2/1988 | Perry . | |
| 4,998,544 | 3/1991 | Obergfell . | |
| 5,174,312 | 12/1992 | Adams . | |
| 5,186,186 | 2/1993 | Hamilton . | |
| 5,233,704 | 8/1993 | Booher . | |
| 5,239,705 | 8/1993 | Leopold . | |
| 5,293,884 | 3/1994 | Chapman . | |
| 5,321,854 | 6/1994 | Kronenberger . | |
| 5,416,925 | 5/1995 | Davis | 2/144 |
| 5,456,270 | 10/1995 | Wong . | |
| 5,461,726 | 10/1995 | Wade | 2/144 |
| 5,472,003 | 12/1995 | Frame . | |
| 5,511,249 | 4/1996 | Higgins . | |
| 5,535,765 | 7/1996 | Takashima . | |
| 5,546,603 | 8/1996 | Lawhorne . | |
| 5,590,422 | 1/1997 | Henderson . | |
| 5,598,585 | 2/1997 | Stroup . | |
| 5,615,414 | 4/1997 | Landis . | |
| 5,787,904 | 8/1998 | Michaud . | |

*Primary Examiner*—John J. Calvert
*Assistant Examiner*—Katherine Moran
*Attorney, Agent, or Firm*—Horst M. Kasper

[57] ABSTRACT

A combination head/hair band and the hair gathering device (s) comprised of two or more joined flexible textile loops featuring adjustable circumferences. The first loop is intended to wrap around the users head and serve as a head/hair band. The second loop or loops is/are attached to the primary loop at the location(s) from which gathered hair, i.e. ponytail/pigtails/hair braid(s), are intended to be secured. The gathered hair is routed through the second loop(s) and secured by tensioning of slide device(s) defining the loop circumferences. In the one embodiment, a single length of a flexible textile cordage is routed over the wearers head and both ends are then routed through a first slide device positioned underneath the hair at the back of the head. The hair is then gathered and the cord ends are routed around opposite sides of the gathered hair, and tensioned and secured with a second slide device. The device is very elegant in its simplicity and effectiveness in restraining the hair.

14 Claims, 7 Drawing Sheets

HEAD BAND, HAIR BAND AND HAIR GATHERING DEVICE

BACKGROUND OF THE INVENTION

1. Field of the Invention

The present invention relates to fashionable hair accessories and hair holding devices such as a combination of head/hair bands with hair gathering devices.

2. Brief Description of the Background of the Invention Including Prior Art

Devices combining a head band or hair band with a hair gathering device are known.

Stephen D. Obergfell (U.S. Pat. No. 4,998,544) teaches a head band with an integral pony tale aperture formed at the rear of the head band, directing hair horizontally rearward.

Katherine L. Stroup (U.S. Pat. No. 5,598,585) teaches a headband designed with "U" shaped ends wherein the ends would form and opening through which a ponytail could pass when wrapped around the wearers head and secured at the rear.

Charles S. Lawhorne, Kerry B. Lawhorne and Laura M. Helyer (U.S. Pat. No. 5,546,603) teach headbands which incorporated openings through which a ponytail could pass.

Timothy J. Landis (U.S. Pat. No. 5,615,414) teaches a self forming visor apparatus having a hole incorporated at the rear, wherein a ponytail can be routed through the hole.

The Obergfell, Stroup, Lawhorne and Landis patents teach an arrangement wherein the ponytail holder was essentially an opening designed into the rear portion of a horizontally oriented headband arrangement. The hair to be retained i.e. the ponytail must be threaded through the hole provided.

Donna J. Henderson (U.S. Pat. No. 5,590,422) teaches a combined headband and hair retainer comprised of an elastic headband and a malleable tie device secured thereto, wherein the malleable tie device would be wrapped and/or twisted around gathered hair with the malleable tie device having sufficient rigidity to form a ponytail holder. The Henderson patent teaches an arrangement wherein a separate device is furnished for securing the ponytail, wherein the device holds the ponytail as a result of malleable deformation.

Gary D. Lawrence (U.S. Pat. No. Des. 344,176) shows an ornamental design for a headband wherein the headband is terminated at the rear of the head with a pouch and wherein the pouch would be used for receiving and covering a ponytail. The Lawrence patent teaches a fabric pouch forming the rear portion of a headband, wherein the pouch can be used for storing, or for containing a gathered ponytail.

Perry in U.S. Pat. No. 4,723,325 teaches a combination sweatband and facial towel and which is twisted into two loops.

Hamilton in U.S. Pat. No. 5,186,186 teaches a multipurpose ornament and method for use in retaining hair. The body ornament includes an elastic retainer member which releasably engages the body ornament to the mass of the hair.

Chapman et al. in U.S. Pat. No. 5,293,884 teach a loop strap hair tie of a certain shape. Frame et al. in U.S. Pat. No. 5,472,003 teach a hair accessory for ponytail. A bottom loop 16 grips the hair to position the bottom loop 16 and set the effective length of the sleeve 12 relative to the ponytail. Higgins in U.S. Pat. No. 5,511,249 teaches a cap with crown opening. Takashima in U.S. Pat. No. 5,546,603 teaches a hair binder including an elastic hair band and frames forming a circle. Michaud in U.S. Pat. No. 5,787,904 teaches an adjustable hair holder and method for retaining hair.

A consistent problem with conventional individual hair/head bands and hair retaining devices has been a tendency for the device to move and/or fallout of the wearer's hair.

SUMMARY OF THE INVENTION

1. Purposes of the Invention

It is an object of the present invention to provide a decorative and utilitarian combination of a hair/head band with a hair gathering device.

It is a further object of the present invention to furnish a holder for a pony tail, which is both effective as well as esthetically attractive.

It is yet a further object of the present invention to furnish an adjustable hair band as well as an adjustable holder for a pony tail.

These and other objects and advantages of the present invention will become evident from the description which follows.

2. Brief Description of the Invention

According to the present invention flexible textile loops which are formed in various manners and joined as appropriate to mutually guide and support, are utilized for holding the hair/head band and hair retaining portions at appropriate locations on the wearer's head. The flexible nature of the loops allows the wearer to position the invention as style or comfort dictates and allows the head/hair band and hair retainer portions to serve their independent functions. The length and therefore the enclosed area of the individual loops is adjustable through the use of mechanical slide devices, so as to fit the individual wearer at the intended location and secure the hair in position. The juncture between the independent loops of the present invention helps to hold the loops in an intended position while offering the flexibility necessary to allow for hair movement and wearer comfort. The support offered the hair gathering loop by the hair/head band loop allows the wearer to loosely place the hair gathering loop around the secured hair without the loop falling out.

The present invention furnishes a utilitarian alternative configuration for fashion and hair securing devices.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 7 is a perspective view of yet another slide device formed out of a flexible strap which is rolled into a cylindrical configuration and fastened so as to form a single passage for the cord sections to pass through.

DESCRIPTION OF INVENTION AND PREFERRED EMBODIMENT

Figure 1:
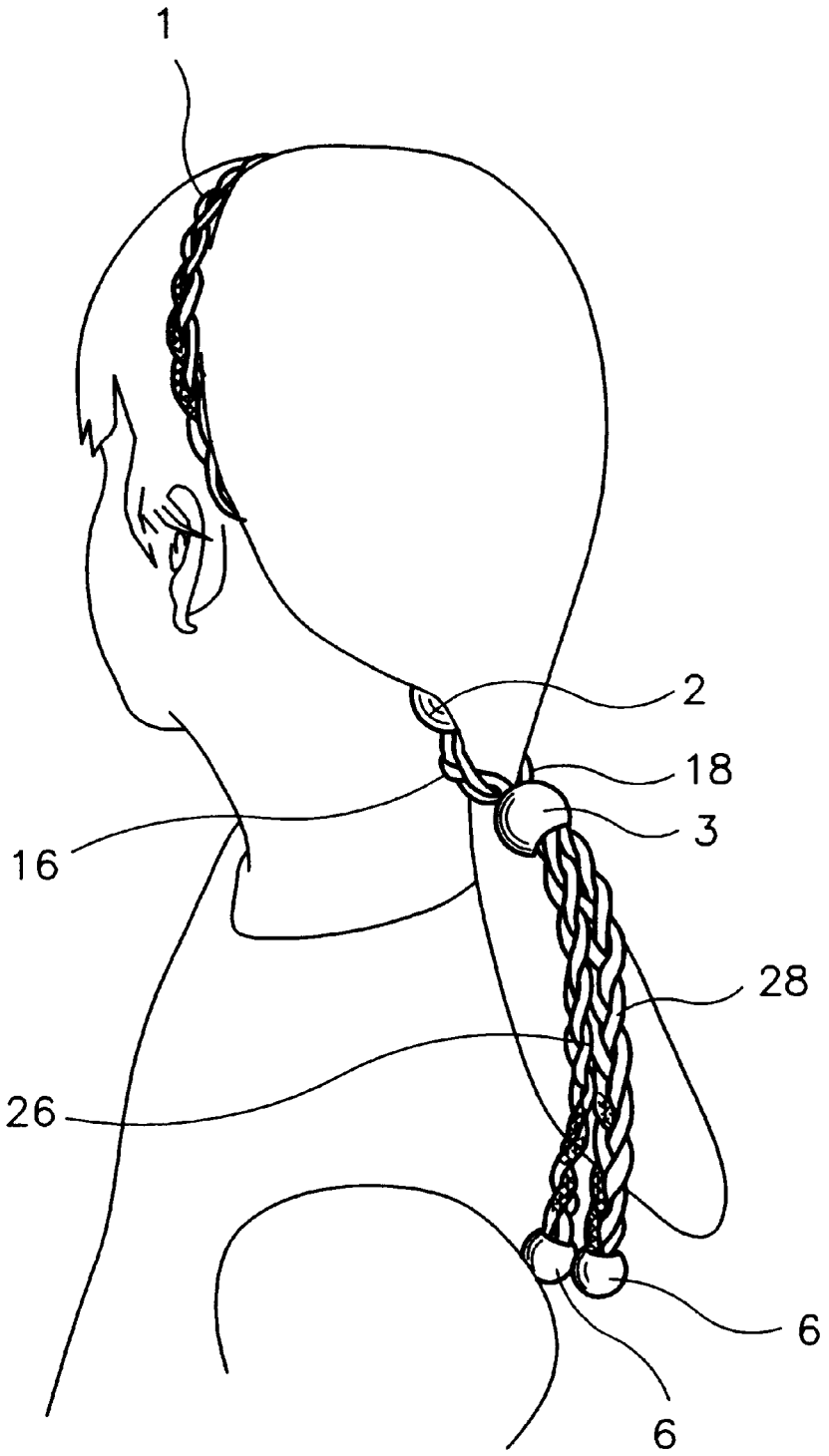
FIG. 1 is a side perspective view of a head band, hair band and hair gathering device as worn by a person.

The embodiment of the present invention as shown in FIG. 1 is comprised of three basic elements: a flexible textile cord 1, a first slide device 2, and a second slide device 3. The ends of the flexible textile cord 1 are routed and guided through the first slide device 2 and then through the second slide device 3. The first slide device 2 and the second slide device 3 subdivide the flexible textile cord 1 such that a first loop 4 (FIG. 2) is formed between the middle section 12 of the cord and the first slide device 2 and that a second loop 14 is formed between the first slide device 2, a first flexible cord section 16 adjacent to the middle section 12 of the cord 1, the second slide device 3 and a second adjacent section 18 of the flexible cord 1 adjoining the middle section 12 of the cord 1. Thus two loops 4, 14 are present with the first loop 4 disposed between the closed-end middle section 12 of the cord 1 and the first slide device 2 and with the second loop 14 disposed between the first slide device 2 and the second slide device 3.

The perspective view of the first preferred embodiment of the invention in FIG. 1 is schematically illustrating: the first loop 4 wrapped over the wearers head and secured at the first slide device 2 positioned under and partially hidden under a gathered ponytail 34. The second loop 14 extends from the first slide 2, with cord sections 16 and 18 wrapping around opposite sides of the ponytail 34 and secured at the second slide device 3, behind the ponytail 34. The loose ends 26, 28 of the flexible cordage 1 are dangling from the second slide device 3.

Figure 2:
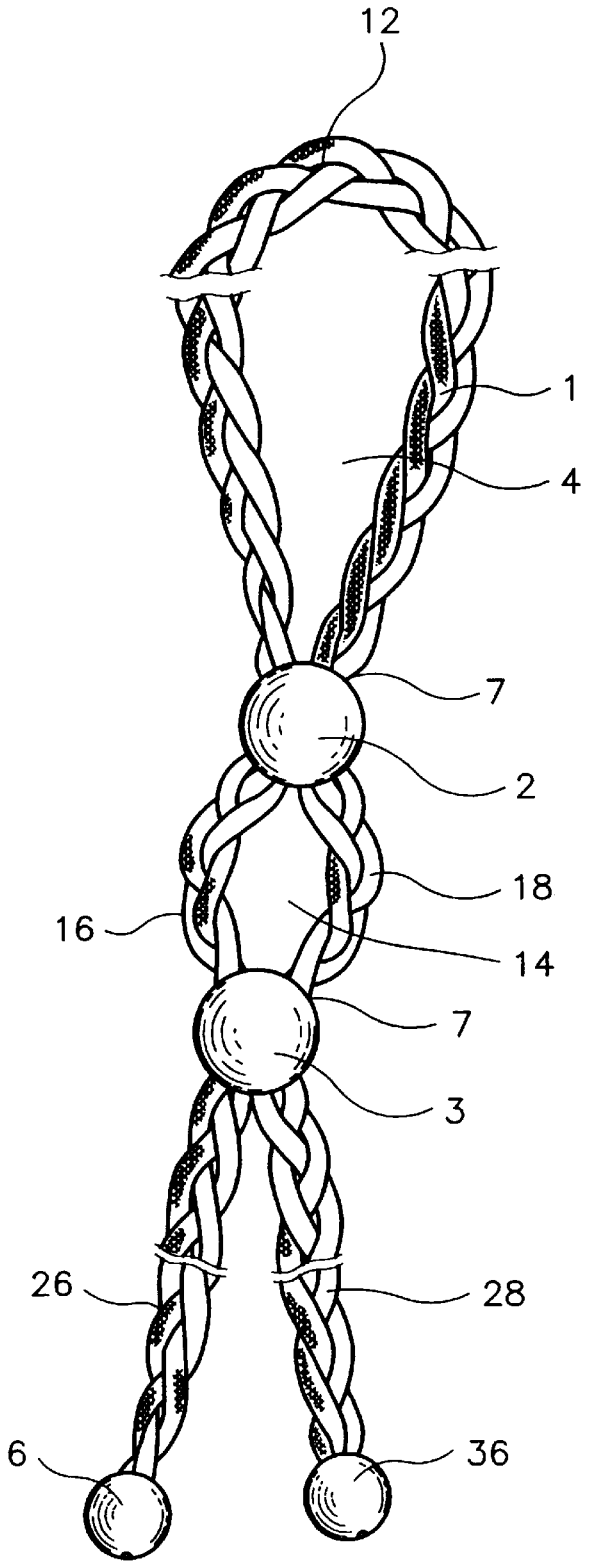
FIG. 2 is top planar view of a layout sketch of the head band, hair band and hair gathering device of FIG. 1.

A view of the head band, hair band or hair gathering device for the head of a person as laid out on a horizontal surface for example is shown in the sketch of FIG. 2. The layout sketch of the first preferred embodiment of the invention depicts the basic components in FIG. 2: the flexible textile cord 1 with its middle section 12, the first slide device 2, and the second slide device 3. The area 104 is enclosed by the first loop 4, the area 114 is enclosed by the second loop 14, and the two ends 26, 28 of the cord 1 are disposed freely dangling and have end decorations and stabilizers 6, 36.

Figure 3:
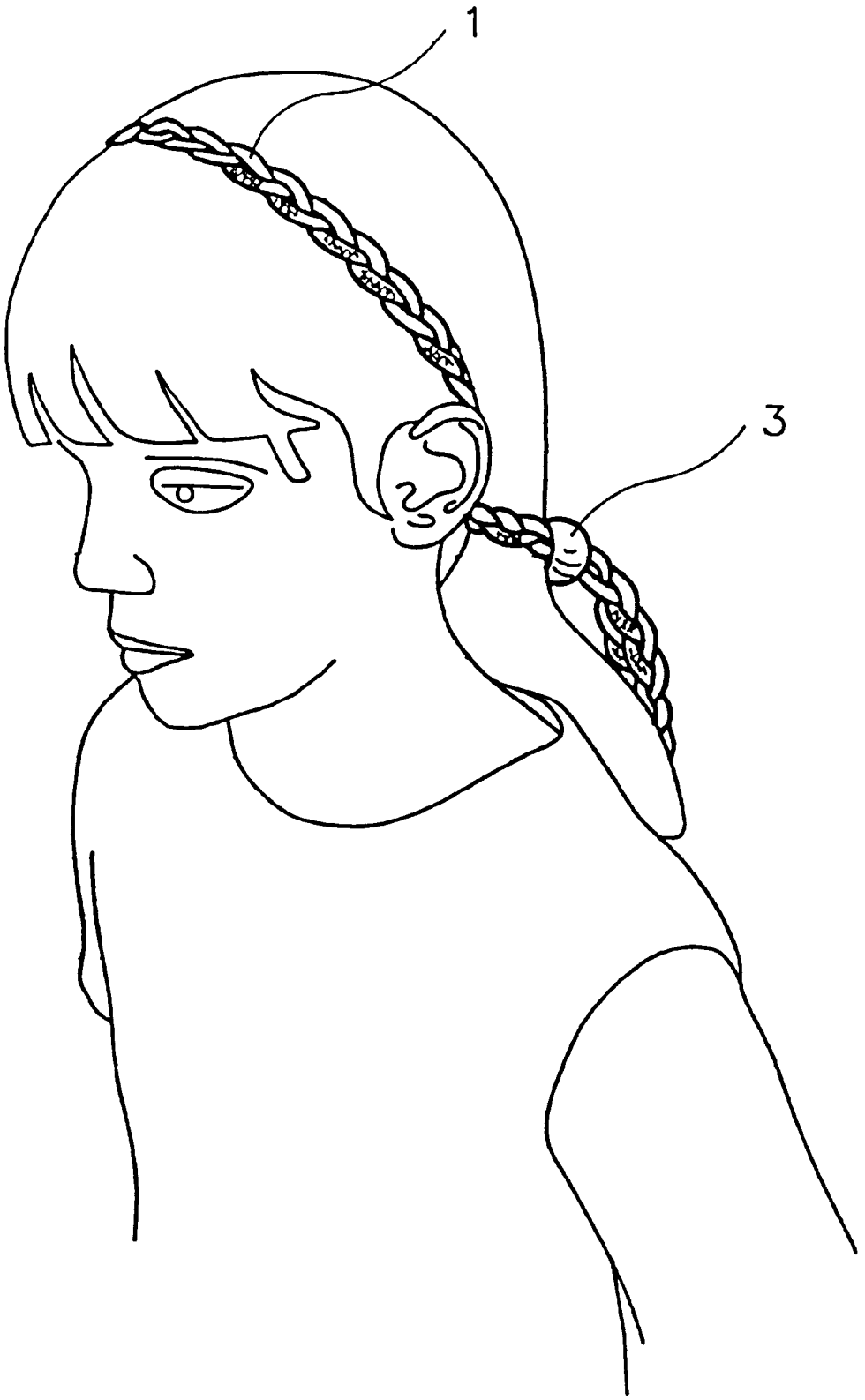
FIG. 3 is a side perspective view of a head band, hair band and hair gathering device as worn by a person of FIG. 1.

A perspective view of a wearer of the first embodiment of the present invention is shown in FIG. 3 and illustrates the application of the second loop 14 closed by second slide device 3, comprised of a ball with a central bore hole, to define and stabilize a pony tail. In this configuration the second loop 14 can be loosely applied and kept from falling out of the hair by its juncture with the first loop 4.

The head band, hair band and hair gathering device is applied to a person by routing or disposing the first loop 4 around the wearers head followed by adjusting a position of the first slide device 2 for a proper fit of the head band, hair band and hair gathering device around the head. The hair to be retained and bundled is then inserted into and passed through the second loop 14. The retained hair can then be secured by adjusting a position of the second slide device 3, causing the second loop 14 to tighten. The free ends 26, 28 of the flexible textile cord are protruding from the second slide device 3 and are allowed to dangle for showing a decorative effect. The first slide device 2 and in particular the second slide device 3 can be ornamented with decorative elements. Devices 6, 36 applied to the free ends of the flexible textile cord 26, 28 may also be provided with additional decorative elements which may also serve the purpose of preventing the cord end from unraveling.

The slide devices 2, 3 shown in FIGS. 1, 2 and 3 are constructed from a body having an inner hollow passage 7 through the body of the slide device. The inner hollow passage is preferably a cylindrical passage. The diameter of the cylindrical passage is preferably such that the cord ends 26, 28 pass through the body, but sufficient friction is generated between the two cord sections or between the cord sections and inside diameter of the passage 7 for the two cord sections to resist being moved relative to the slide devices 2, 3, unless intentionally adjusted by the user. Furthermore, the cords 1 are dimensioned such relative to the hole that when extending in parallel to the longitudinal axis of the cylindrical passage, the two cords can be pulled together or independently through the cylindrical passage opening 7 by hand against the frictional resistance. A frictional force in the range of 17 to 27 newton has been determined to be appropriate to meet both the goal of retaining the slide devices 2, 3 at a selected relative position of cord 1 yet allow the user to intentionally adjust the relative position of the cord(s) 1 to the slide devices 2, 3.

The length of the cord 1 will depend on the size of the head of the person and thus will depend indirectly on the age of the person. The length of the cord 1 can be from about 100 centimeters to 150 centimeters and is preferably from about 115 to 130 centimeters.

A cord with this length will be suitable for the majority of the population. The cord 1 employed according to the invention is to exhibit a sufficient frictional force relative to other sections of the cord 1 and relative to the slide devices 2, 3 such that upon application of the head band, hair band and hair gathering device to the head of a person and upon surrounding a pony tail will not shift during normal wear, but will give in case of a particular stress situation. The cord 1 can be a braided cord as shown the braid can be composed of three strands, which in turn can be braided. The employment of braided cords 1 generally is associated with desirable frictional properties as outlined above.

The braid material is furnished preferably by a fiber material made of organic chemistry compositions, which material can be man-made or derived from natural fibers. Such materials include wool, cotton, hemp, linen, polyester, acrylic, polyethylene, polypropylene, Nylon, polyamides. The diameter of the strands comprising cord 1 can be from about 2 to 10 millimeters and are preferably from about 4 to 7 millimeters.

A braid is a flat, round or tubular narrow fabric made by intertwining a single set of yarns to form a definite pattern. Round braid strands are preferred in the context of the present invention. The braid is made by diagonal interlacing of one set of strands by a method often called plaiting, in which individual strands form a zig-zag pattern as they crisscross one another, and no adjacent strands make complete turns around each other. At least three strands are required for braiding and braiding several strands resembles the interlacing for plain weaving. Thus a braid is a narrow tubular, round or flat fabric produced by intertwining a single set of yarns according to a definite pattern. A braid is a structure produced by interlacing several ends of yarns in a manner such that the paths of the yarns are not parallel to the fabric axis.

The slide devices 2, 3 can be bodies of any kind desired as long as they are capable of meeting the requirements of being able to withstand the use subjected to in connection with a head band or hair band with a hair gathering device. The requirements for this application are primarily the generation of sufficient friction to resist unintentional movement with respect to the cord sections while allowing the intentional adjustment of the slide position, the ability to resist mechanical damage from wear, chemical exposure on wearer's hair and to offer a desirable decorative effect. Preferably they are made of solid materials such as for example, wood, metal, plastic, leather, stone, ivory, bone, glass, porcelain. The shape of these slide devices can vary and be cubic, ellipsoidal, ball shaped, trapezoidal, parallel epipedal, irregular, symmetrical, artistic. The diameter of the cylindrical passage in the slide devices 2, 3 depends on the kind of braid employed by the invention and is determined by the friction generated between the braid or between two parallel disposed strands in the cylinder passage. The friction has to be such that it is possible to shift the sleeve device during installation or removal of the head band or hair band with a hair gathering device on the head of a person, but once the head band or hair band with a hair gathering device is installed on the head, then the head band or hair band with a hair gathering device will substantially retain its position versus the position of the hair of the person. For example, the diameter of the cylindrical passage 7 can be from about 0.8 to 2.0 and preferably from about 1.1 to 1.7 times the loose diameter of a single braid to be used in the head band or hair band with a hair gathering device according to the present invention.

Figure 5:
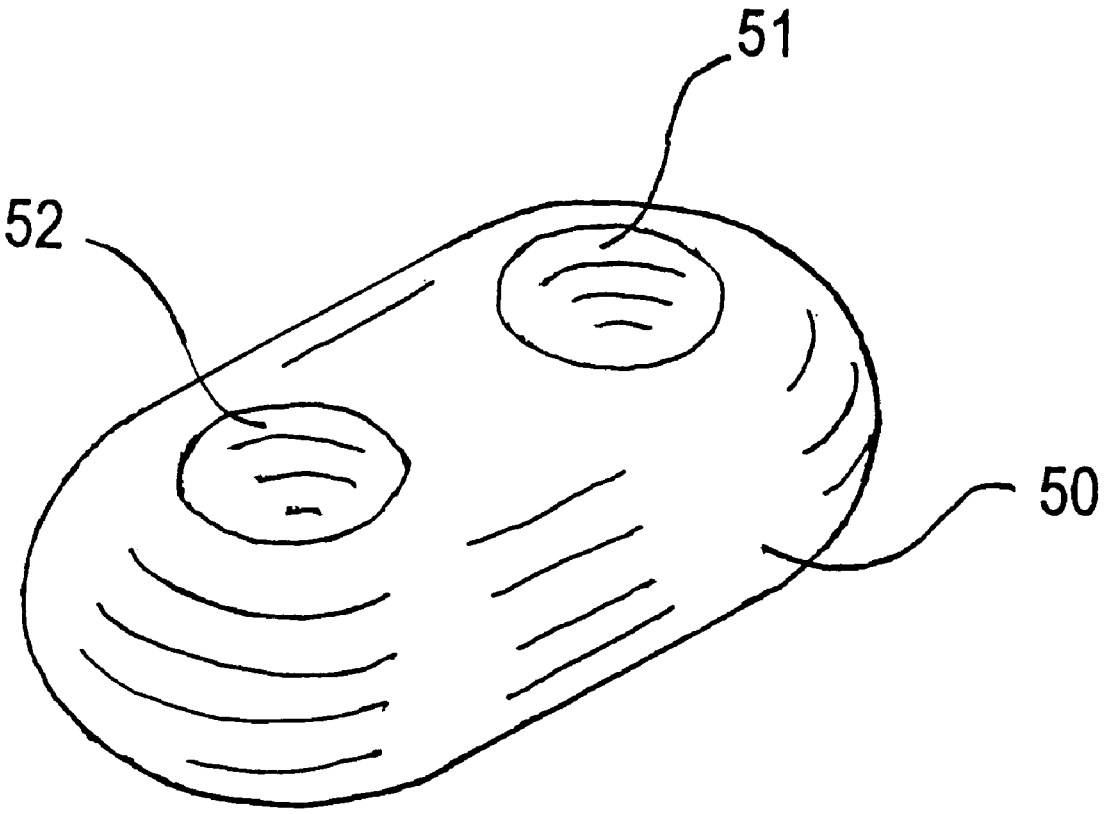
FIG. 5 is a perspective view of another slide device formed out of a solid and incorporating two independent passages for the cord sections.
Figure 6:
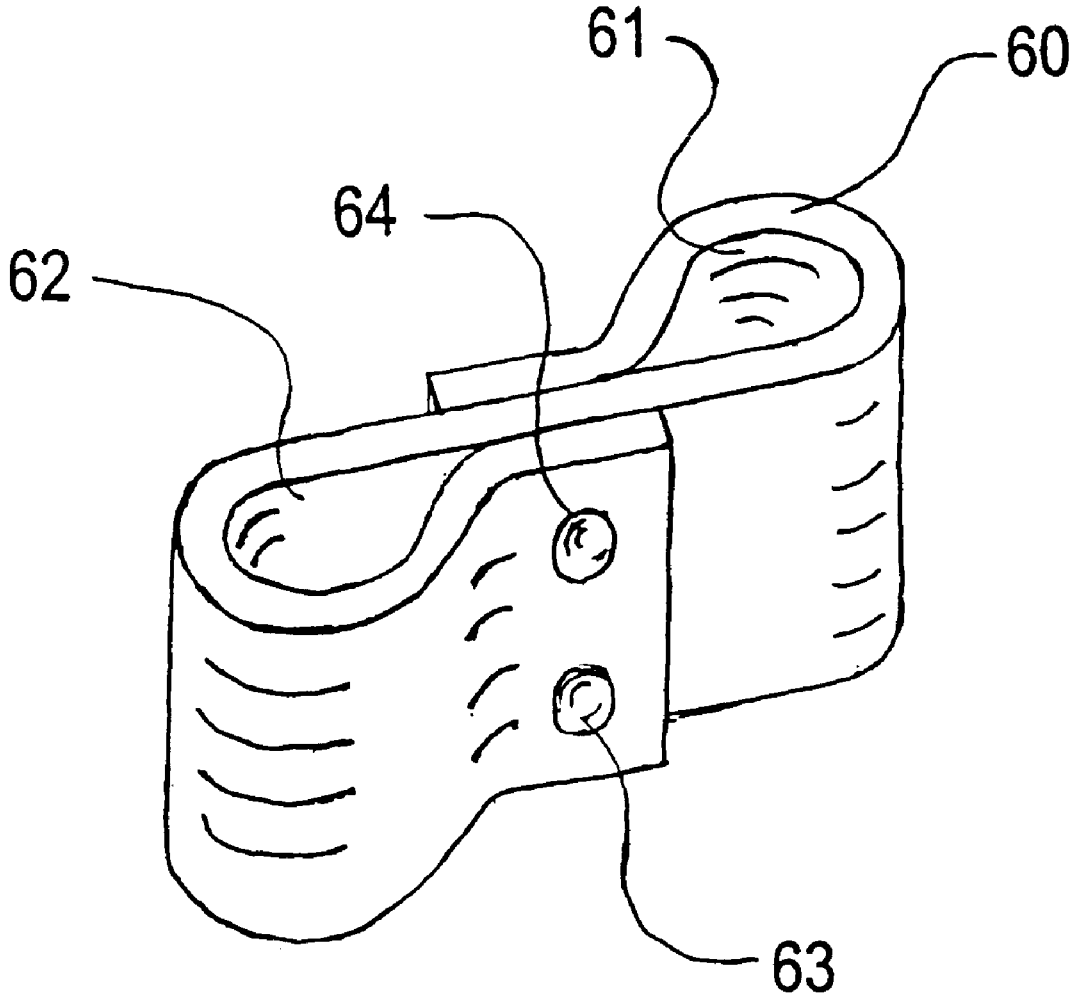
FIG. 6 is a perspective view of another slide device formed out of a flexible strap which is folded back onto itself and fastened to form two independent passages for the cord sections.
Figure 7:
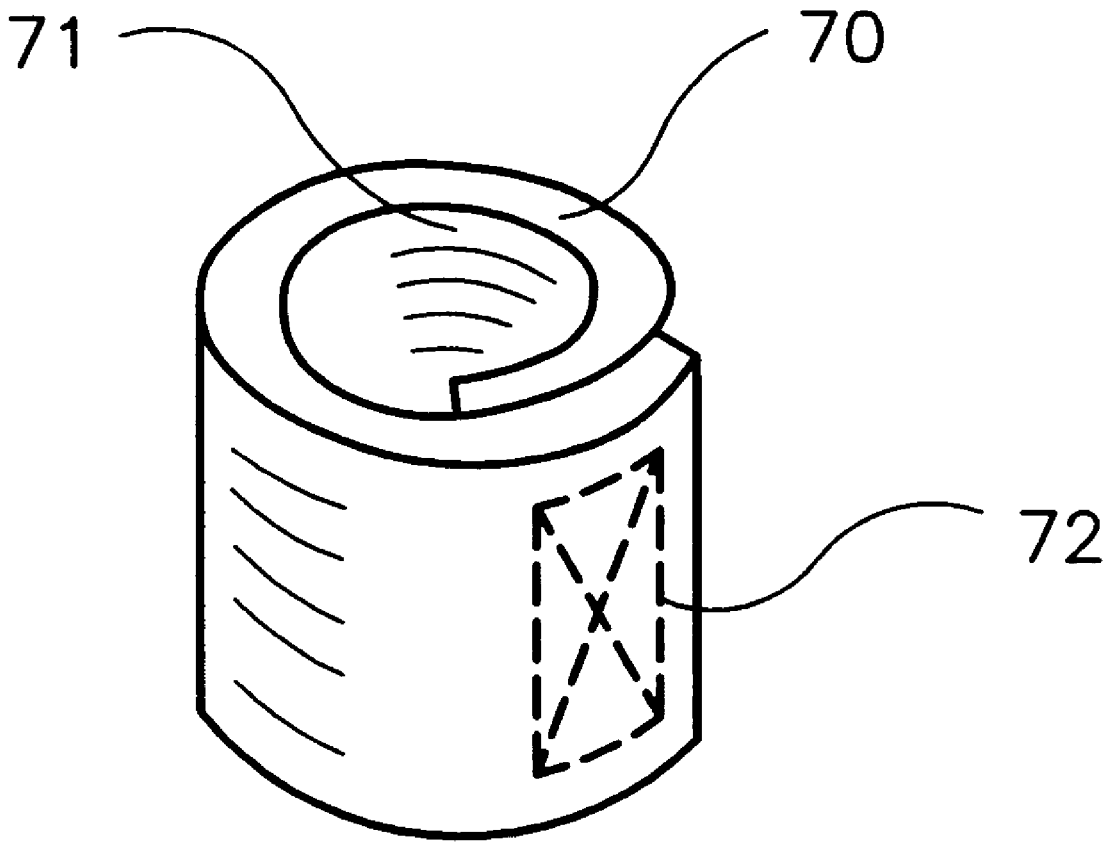

Three additional slide devices which could be applied to use in the subject invention are shown in FIGS. 5, 6 and 7. FIG. 5 shows a solid body 50 having two inner hollow passages 51, 52 through which the cord ends 26, 28 can be routed. The passages are preferably cylindrical in configuration with the edges rounded so as not to drag or wear on the cord sections excessively. As was previously described the diameter of the cylindrical passages must be sized to match the textile cord 1, creating the friction necessary to resist unintentional movement of the slide device with respect to the cord section.

FIG. 6 schematically depicts a slide device formed out of a single length of a flexible strap material 60 which has been folded back on itself at both ends so as to form two passages 61, 62 through which the cord ends 26, 28 can be routed. The ends of the strap are secured to the mid section of the strap by use of rivets 63, 64. The rivets are placed in holes provided at one end of the strap, extend through holes at the mid section of the strap, extend through holes provided at the opposite end of the strap where they are secured by forming the ends into a crown in a process known as clinching or heading. As with the other devices, the passages 61, 62 must be sized appropriately with respect to the cord 1 to meet the friction and securing requirements previously outlined. The strap 60 can be manufactured out of any suitable material, such as plastic or leather.

FIG. 7 shows a slide device formed out of a single length of flexible strap material 70 which has rolled into a cylindrical shape, overlapping at the ends forming a cylindrical passage 71 through which two segments of cord 1 can be routed. The overlapping ends of strap material 70 are secured to one another by means above stitching 72. The strap 70 can be manufactured out of any suitable material, such as plastic or leather.

Figure 4:
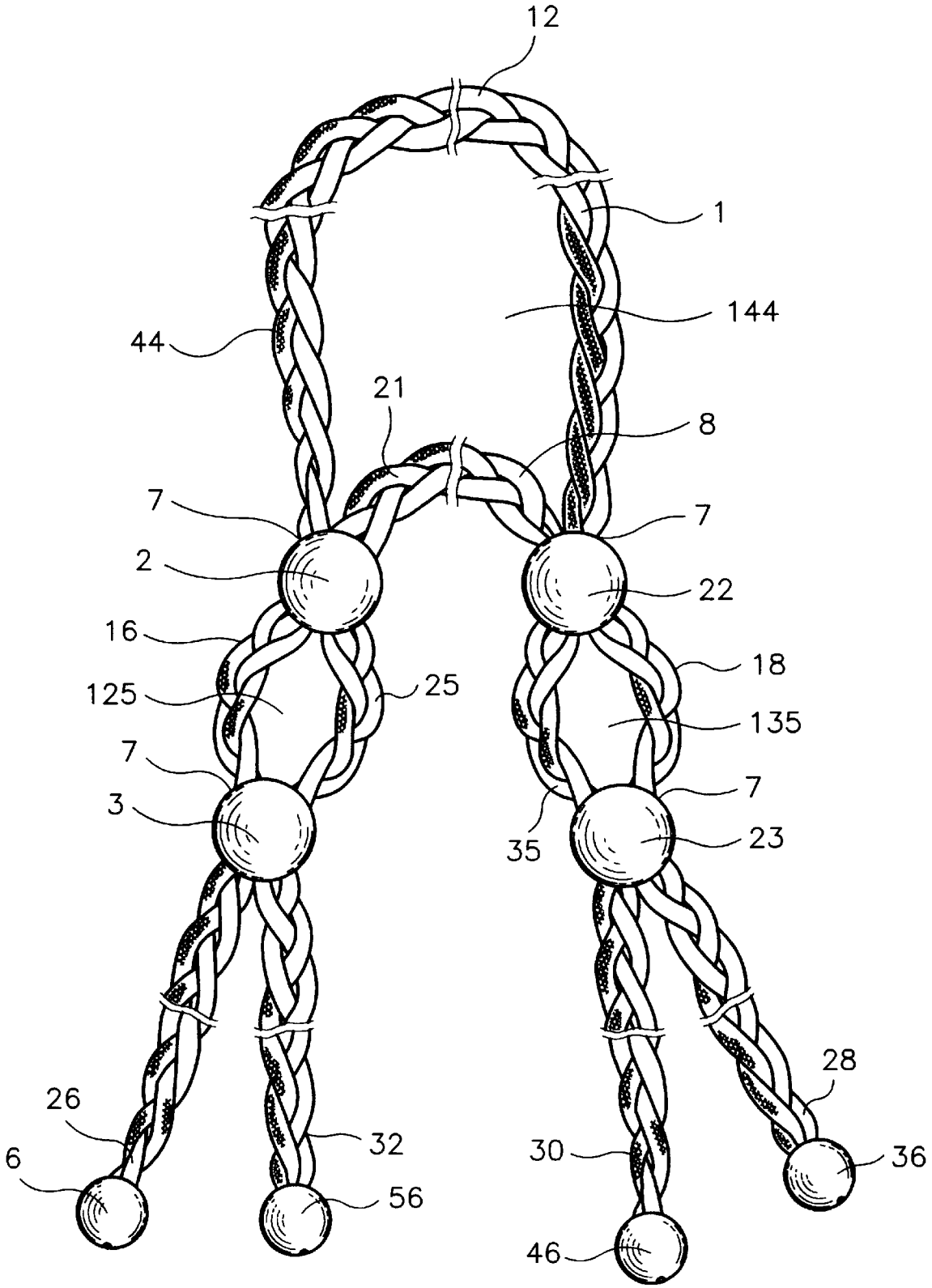
FIG. 4 is a top planar view of a second embodiment of a head band, hair band and hair gathering device as worn by a person.

A second device embodiment of the present invention is shown in FIG. 4 and is similar to the first embodiment set forth above, but is constructed for supporting two pony tails (pigtails) on one head. A third slide device 22 and a fourth slide device 23 are employed, wherein the functioning of the third slide device 22 is parallel to that of the first slide device 2 and wherein the functioning of the fourth slide device 23 is similar to that of the second slide device 3. Terminating elements are to be attached to the ends 26, 28, 30, 32 of the flexible cord(s) after the second slide device 3 and, respectively, the fourth slide device 23 has or have been installed. Instead of a single textile cord 1 the embodiment of FIG. 4 employs two cords 1, 21. The middle part 12 of the longer first cord 1 is defined by the position of the first slide 2 and of the third slide 22 relative to the first cord 1. Similarly, the middle part 8 of the shorter second cord is defined by the position of the first slide 2 and of the third slide 22 relative to the second cord 21. The area 144 enclosed by loop 44 has a parallel function with the area 104 enclosed by loop 4 in the first embodiment. This area is defined by the length of first cord 1 mid section 12 and the length of second cord 21 mid section 8. The size of loop 44 can be adjusted by moving either the first slide device 2 or the third slide device 22. Areas 125, 135 defined by loops 25 and 35 serve the same function as the area 14 described in the first embodiment. The lateral position of the pigtails are substantially defined by the length of the middle section 8 of the second cord 21. While in the embodiment of FIG. 1 the slide devices 2, 3 each slide along the two opposing sections strands of a single cord 1, the slide devices 2, 3, 22, 23 in the embodiment of FIG. 4 each slide along one section of each of the two cords.

The length of the cord 21 can be from about 30 centimeters to 90 centimeters and is preferably from about 40 to 60 centimeters. The cord 21 has sections 30, 32, similar to end sections 26, 28 of cord 1. The end sections 30, 32 can have associated terminators furnished as end decorations and stabilizers 46, 56. The end decorations and stabilizers 46, 56 perform the same stabilizing function as do the end decorations and stabilizers 6, 36.

The embodiments described above allow for a variety of decorative features to be added to the head band, hair band and hair gathering device for reasons of fashion or style.

All of these devices can be manufactured out of a variety of materials and colors and can incorporate or be provided with an equally great variety of decorative features.

It will be understood that each of the elements described above, or two or more together, may also find a useful application in other types of hair band configurations and hair supporting procedures differing from the types described above.

While the invention has been illustrated and described as embodied in the context of a head band, a hair band and a hair gathering device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hair band comprising an elongated band having a middle section and a first end and a second end;

a first slide device formed as a solid body and having means guiding and holding the first end section and the second end section of the elongated band wherein the first slide device and the middle section of the band define a first loop adapted to be placed on the head of a person;

a second slide device formed as second means solid body and having a second feature for guiding and holding the first end section and the second end section of the elongated band wherein the first slide device thereby defining a first intermediate section and a second intermediate section of the elongated band, respectively, between the first slide device and the second slide device, wherein the first slide device, the first intermediate section, the second slide device and the second intermediate section define a second loop adapted to surround a ponytail.

2. The hair band according to claim 1 wherein the elongated band is a braided textile.

3. The hair band according to claim 1 wherein the elongated band is a round braid.

4. The hair band according to claim 1 wherein the elongated band is a round braid formed from three strands.

5. The hair band according to claim 1 wherein the first slide device is a ball having a central borehole and wherein the second slide device is a ball having a central borehole.

6. The hair band according to claim 1 wherein the first slide device is an oblong solid having two symmetric bore holes and wherein the second slide device is an oblong solid having two symmetric bore holes.

7. The hair band according to claim 1 wherein the first slide device is formed from a single piece of flexible strap material folded back on itself at both ends and secured so as to form two passages.

8. The hair band according to claim 1 wherein the first slide device is formed from a single piece of flexible strap material rolled into a cylindrical shape and secured so as to form a central passage and wherein the second slide device is formed from a single piece of flexible strap material rolled into a cylindrical shape and secured so as to form a central passage.

9. The hair band according to claim 1 further comprising a first end piece attached to a free end of the first end section for stabilizing the first end section; and a second end piece attached to a free end of the second end section for stabilizing the second end section.

10. A hair band comprising a first loop including a middle section of an elongated band and a first slide device, wherein the first slide device is formed as a solid body and having means for guiding and holding the elongated band and wherein the first loop is adapted to be placed on the head of a person;

a second loop including the first slide device, a first intermediate section of the elongated band, and a second slide device, wherein the second slide device is formed as a solid second body and having second means for guiding and holding the elongated band and wherein the second loop is adapted to be placed surrounding a ponytail;

a first end section formed by the elongated band defined by the position of the second slide device and said first end section freely movable beyond the second slide device.

11. The hair band according to claim 10 wherein the middle section of the elongated band passes at a second side through the first slide device;

a second intermediate section of the elongated band is disposed between the first slide device and the second slide device with the elongated band passing a second time through the first slide device and with the elongated band passing a second time through the second slide device; and further comprising a second end section formed by the elongated band defined by the position of the second slide device and said second end section freely movable beyond the second slide device.

12. The hair band according to claim 10 wherein the first loop further comprises a second middle section of a second elongated band, wherein the second elongated band passes through the first slide device;

a third slide device, wherein the third slide device is formed as a solid third body having third means for guiding and holding the elongated bands with the first elongated band passing through the third slide device, and with the second elongated band passing through the third slide device; and wherein the second loop further comprises a second intermediate section of the second elongated band, wherein the second elongated band passes through the second slide device; and further comprising a second end section formed by the second elongated band defined by the position of the second slide device and said second end section freely movable beyond the second slide device;

a third loop including a third slide device, a third intermediate section of the first elongated band, a fourth slide device, and a fourth intermediate section of the second elongated band, wherein the fourth slide device is formed as a solid fourth body having fourth means for guiding and holding the elongated band with the first elongated band and the second elongated band passing through the fourth slide device and wherein the third loop is adapted to be placed surrounding a second ponytail; a third end section formed by the elongated band defined by the position of the fourth slide device and said third end section freely movable beyond the second slide device; and a fourth end section formed by the second elongated band defined by the position of the fourth slide device and said fourth end section freely movable beyond the second slide device.

13. The hair band according to claim 12 further comprising a first end piece attached to a free end of the first end section for stabilizing the first end section;

a second end piece attached to a free end of the second end section for stabilizing the second end section a third end piece attached to a free end of the first end section for stabilizing the first end section; and a fourth end piece attached to a free end of the second end section for stabilizing the second end section.

14. The hair band according to claim 10 wherein the elongated band is a braid.

* * * * *